US010030959B2

(12) United States Patent
Park

(10) Patent No.: US 10,030,959 B2
(45) Date of Patent: Jul. 24, 2018

(54) BLASTING SYSTEMS AND METHODS

(71) Applicant: Allen Park, Salter Point (AU)

(72) Inventor: Allen Park, Salter Point (AU)

( * ) Notice: Subject to any disclaimer, the term of this patent is extended or adjusted under 35 U.S.C. 154(b) by 0 days.

(21) Appl. No.: 14/898,568

(22) PCT Filed: Jun. 16, 2014

(86) PCT No.: PCT/AU2014/050072
§ 371 (c)(1),
(2) Date: Dec. 15, 2015

(87) PCT Pub. No.: WO2014/201514
PCT Pub. Date: Dec. 24, 2014

(65) Prior Publication Data

US 2016/0138899 A1 May 19, 2016

(30) Foreign Application Priority Data

Jun. 17, 2013 (AU) ..... 2013902178

(51) Int. Cl.
*F42D 1/28* (2006.01)
*F42D 1/12* (2006.01)

(52) U.S. Cl.
CPC ..... *F42D 1/28* (2013.01); *F42D 1/12* (2013.01)

(58) Field of Classification Search
CPC ..... F42D 1/24; F42D 1/26; F42D 1/28; F42D 1/08; F42D 1/12
USPC ..... 102/301, 304, 313, 333
See application file for complete search history.

(56) References Cited

U.S. PATENT DOCUMENTS 3,063,373 A * 11/1962 Boddorff ..... F42D 1/12 102/313
8,413,584 B2 * 4/2013 Mills ..... F42D 1/24 102/313
8,627,769 B2 * 1/2014 Mills ..... C04B 28/065 102/313
2011/0259227 A1 10/2011 Mills et al.

FOREIGN PATENT DOCUMENTS

DE 4244617 A1 * 7/1994 ..... F42D 1/28
GB 1045098 A * 10/1966 ..... F42D 1/08
GB 2099117 A * 12/1982 ..... F42D 1/20
GB 2336863 A 11/1999

(Continued)

OTHER PUBLICATIONS

International Preliminary Report on Patentability under Chapter I of the Patent Cooperation Treaty (including Forms PCT/IB/373 and PCT/ISA/237) for International Application No. PCT/AU2014/050072, dated Dec. 22, 2015 (5 pages).

(Continued)

*Primary Examiner* — James S Bergin
(74) *Attorney, Agent, or Firm* — Withrow & Terranova, P.L.L.C.; Vincent K. Gustafson

(57) ABSTRACT

In one preferred form of the present invention there is provided a method of stemming a blast hole with a super absorbent polymer. The method includes providing a super absorbent polymer substance as a gelled length in the blast hole. The gelled length provides a pressure wave reflecting stem, to increase the efficiency of an explosive during blasting, with the explosive being located in the blast hole.

16 Claims, 10 Drawing Sheets

(56) References Cited

FOREIGN PATENT DOCUMENTS

| | | | | |
|---|---|---|---|---|
| JP | H06-174400 | A | | 6/1994 |
| RU | 30830 | U1 | | 7/2003 |
| RU | 2291391 | C1 | * | 1/2007 |
| RU | 2356810 | C1 | | 5/2009 |
| SU | 826022 | A1 | | 4/1981 |
| SU | 1810535 | C | | 4/1993 |
| SU | 1810575 | C | | 4/1993 |
| UA | 17322 | U | | 9/2006 |
| WO | 2002-084206 | A1 | | 10/2002 |
| WO | 2012090165 | A1 | | 7/2012 |

OTHER PUBLICATIONS

International Search Report (Form PCT/ISA/210) for International Application No. PCT/AU2014/050072, dated Jul. 31, 2014 (3 pages).

Extended European Search Report for European Patent Application No. 14814438.9, dated Dec. 1, 2016 (7 pages).

Shi, Jianguo, "New Hydrogel Blasthole Stuffing," Metallurgical Safety Editorial, China, May 31, 1981.

Examination Report No. 1 for Australian Innovation Patent No. 2017100377 dated Jun. 23, 2017, 5 pages.

First Office Action for Chinese Patent Application No. 201480034572.X, dated Oct. 31, 2016, 30 pages including English translation.

Second Office Action for Chinese Patent Application No. 201480034572.X, dated Aug. 2, 2017, 25 pages including English translation.

Third Office Action for Chinese Patent Application No. 201480034572.X, dated Mar. 8, 2018, 21 pages including English translation.

Katanov I. B., "Rational Content of Components in the Druming Units of Well-Bit Charges," Geotechnology, UDC 622.765, No. 6, 2009, pp. 35-37.

First Office Action for Russian Patent Application No. 2016101138/03, dated Apr. 11, 2018, 16 pages including English translation.

* cited by examiner

Fig. 6 Pumping and Mixing Diagram

Fig. 10

| Rock A | | | | | |
|---|---|---|---|---|---|
| *VOD at end of Detonation* | *Ave. velocity over 0-200mm of stemming* | *% reduction in velocity* | *Calculated Detonation Pressure* | *Detonation Pressure at 200mm of stemming* | *%Reduction in Detonation Pressure at 200mm* |
| 5000 m/s | 2439 | 51% | 7.5GPa | 0.14 GPa | 98% |
| **Rock B** | | | | | |
| *VOD at end of Detonation* | *Ave. velocity over 0-660mm of stemming* | *% reduction in velocity* | *Calculated Detonation Pressure* | *Detonation Pressure at 660mm of stemming* | *%Reduction in Detonation Pressure at 660mm* |
| 5000 m/s | 1625 m/s | 67.5% | 7.5GPa | 0.084 GPa | 99% |

BLASTING SYSTEMS AND METHODS

STATEMENT OF RELATED APPLICATIONS

This application is a 35 U.S.C. § 371 national phase filing of International Application No. PCT/AU2014/050072 filed Jun. 16, 2014, and claims the benefit of Australian Patent Application No. 2013902178 filed on Jun. 17, 2013 in IP Australia. The entire disclosures of International Application No. PCT/AU2014/050072 and Australian Patent Application No. 2013902178 are hereby incorporated by reference herein in their respective entireties.

FIELD OF THE INVENTION

The present invention relates to blasting systems and methods. In one preferred form of the present invention there is provided a stemming method and a stemming arrangement for a blast hole.

BACKGROUND TO THE INVENTION

Control plugs or stemming devices such as the industry standard aggregates being typically 5 mm, 10 mm, 15 mm in diameter, StemPlug blast control plug and the Max-Blast™ blast control plug (both commercially available from BF Carr & Associates, St. Louis, Mo., USA) have been developed and used to improve the efficiency of blasting in the mining industry.

When the stemming devices or control plugs operate as intended, they provide the advantage of reducing the costs of explosives required for blasting operations and associated downstream processing costs.

In circumstances where conventional stemming with aggregates or the control plugs fail in their operation, inconsistent rock breaking can occur which has associated problems with safety, re-blasting and rock processing.

It is against these problems and difficulties associated therewith that the present invention has been developed.

SUMMARY OF THE INVENTION

According to a first aspect of preferred embodiments herein described there is provided a method of stemming a blast hole, the method comprising: providing a gel type substance as a gelled length in the blast hole, as a pressure wave reflecting stem to increase the efficiency of an explosive during blasting with the explosive being located in the blast hole.

According to a second aspect of preferred embodiments herein described there is provided a blast hole arrangement comprising: an explosive and a gel type substance in a blast hole; the gel type substance providing a gelled length in the blast hole as a pressure wave reflecting stem to increase the efficiency of the explosive in the blast hole during blasting.

Preferred embodiments relate to the use of water as a stemming device in blast holes. In such embodiments the water is transformed into a gel using Super Absorbent Polymers (SAP) or any similar reagents having the ability to absorb equal to or more than 25:1 their own weight in demineralised water.

SAP's are also known by the name of Hydrogels. A 25:1 volume to weight ratio being the uptake of demineralised water into the polymer structure officially defines SAP's or Hydrogels as per the Australian Customs Tariff Schedule.

For example 1 gram of Super Absorbent Polymer (SAP) must absorb 25 cubic centimeters of demineralised water to be classified as a SAP.

The gelling reagent used has the ability to gel water over a broad range of water types. From very low TDS to very high TDS (TDS=Total Dissolved Solids). This allows a broad range of water quality to be utilised. For example the TDS that may accommodated can range from 0 mg/l to 100,000 mg/l Sodium Chloride. Preferably the reagent is able to accommodate 25,000 mg/l Sodium Chloride or more.

In one preferred form a gelled or solidified column of water is created on top of the explosive charge. The gelled water is pumped down the bore hole after the explosive charge is set. The column of gelled water fills a column of a desirable height above the explosive charge for the blasting conditions. The gelled column of water may fill the entire bore hole to the surface or be much less than this depending on the circumstances.

In preferred forms an almost instantaneous gelling characteristic of the reagent allows the gel stemming of blast holes from vertical to horizontal bore holes over 360 degrees.

Preferred gel stemming systems according to the invention, find application on surface or in underground blasting. The gel water column may be applied in horizontal bore holes as well as vertical bore holes as the stiff gel will not flow out of the bore hole.

The gelled column of water may have its density increased by the use of soluble or insoluble weighting agents such as sodium chloride (NaCl) or barite, (barium sulphate). This allows the hydrostatic pressure being exerted by the gelled column of water on the bottom and sides of the bore hole to be adjusted. This in turn may relate to balancing of the explosive blast pressure characteristics to the height of the gelled column of water acting as a stemming device.

Both the reflection of the blast pressure wave by the column of gelled water and the hydrostatic pressure being exerted on the bottom and sides of the bore hole advantageously result in controlling explosive blast gases direction and focus.

This may in turn enable the reduction in stem height as compared to conventional methods.

In one preferred method, application is made by dosing the reagent at a measured rate into a water stream. The raw water can be supplied from a water truck, site dam or water storage vessel and pumped in line to the reagent mixing equipment. The raw water constituents or analysis may be from very low Total Dissolved Solids to very high Total Dissolved Solids. The reagent is then dosed into the water stream. Sufficient residence time is allowed for the reaction between the reagent and water to take place forming the gel. Kinetic energy is applied to allow the reaction to occur effectively. A flexible hose is placed in the bore hole and the resulting gelled water is pumped down the bore hole at a measured rate. The resulting gelled water column may fill the entire bore hole. A positive displacement pump is used to pump the gelled water. The hose is removed from the bore hole. The hose is then placed in the next bore hole and the process repeated.

In preferred forms the Super Absorbent Polymer (SAP) reagent may be in the form of a solid (i.e. a powder or granulate), as a fibre or as a liquid. The liquid may be in the form of a solution or in an emulsion form or as a dispersion of discrete particles suspended in a carrier fluid. The SAP's may be of any particle size. The SAP's may or may not be of one or more particle sizes of various chemistry. The SAP's may be applied as cross-linked polymers or they may be cross-linked in situ or they may be used in a combination of both in various proportions. A rheological modifier may be added to the reagent.

In the first aspect there is provided a method of stemming a blast hole, the method comprising: providing a gel type substance as a gelled length in the blast hole to increase the efficiency of an explosive during blasting as a pressure wave reflecting stem, the explosive being located in the blast hole.

Preferably the method includes ensuring that gel type substance includes a substantial quantity of water, the substantial quantity being sufficient to reflect the pressure wave generated by the explosive.

Preferably the method includes providing the gel type substance in the blast hole as a gelled water column that freely contacts the walls of the blast hole.

Preferably the gel type substance is unrestrained so as not to be contained in a plug structure that limits the gelled length, the plug structure and limitation of the gelled length for exerting pressure on the walls of the blast hole.

Preferably providing a gel type substance comprises providing a super absorbent polymer gel; and the method includes pumping the super absorbent polymer gel into the blast hole to create a gelled column of water.

Preferably providing a gel type substance comprises providing a super absorbent polymer gel having hydroscopic and other properties allowing the gel to contact the explosive.

Preferably the method includes ensuring that a zero to near zero interstitial free water volume is provided over a substantial portion of the gelled length; the zero to near zero interstitial free water volume serving to reflect the pressure wave generated by the explosive.

Preferably the method includes pumping the super absorbent polymer gel into the blast hole to proactively fill fissures in the wall of the blast hole.

Preferably the method includes ensuring that the super absorbent polymer gel is substantially water absorbed, at least along a substantial portion of the gelled length of the super absorbent polymer gel.

Preferably the method includes ensuring that the super absorbent polymer gel is substantially water absorbed before entering the blast hole.

Preferably the method includes ensuring that the super absorbent polymer gel is fully water absorbed before entering the blast hole.

Preferably the method includes providing the gelled length as a length of at least 100 mm.

Preferably the method includes providing the gelled length as a length of at least 200 mm.

Preferably the method includes providing the gelled length as a length of at least 500 mm.

Preferably the method includes providing the gelled length as a length of at least 1 m.

Preferably the method includes providing the gelled length as a length of at least 2 m.

Preferably the method includes providing the gelled length as a length of at least 3 m.

Preferably the method includes providing the gelled length as a length of at least 4 m.

Preferably the length provided a vertical height, the vertical height providing a vertical hydrostatic pressure under the action of gravity.

Preferably the method includes providing the gel type substance with a specific gravity of between or equal to 1 and 2.

Preferably the method includes providing the gel type substance with a specific gravity of greater than 1.0.

Preferably the gelled length provides a structure that operates to provide a reduction in detonation pressure, over the gelled length, of at least 99%; at least 98%; at least 90%; or another beneficial amount.

Preferably the gelled length provides a structure that operates to provide a reduction in the velocity of detonation of at least 60%; at least 50%; at least 40%; or another beneficial amount.

Preferably the method includes forming the gel type substance by combining a super absorbent polymer with brackish waste water having a total dissolved solids between 100 to 5000 mg/L.

Preferably the method includes forming the gel type substance by combining a super absorbent polymer with saline waste water having a total dissolved solids greater than 5000 mg/L.

In a second aspect of preferred embodiments herein provided there is provided a blast hole arrangement comprising: an explosive and a gel type substance in a blast hole; the gel type substance providing a gelled length in the blast hole to increase the efficiency of the explosive in the blast hole during blasting.

Preferably the gel type substance includes a substantial quantity of water, the substantial quantity being sufficient to reflect the pressure wave generated by the explosive.

Preferably the gel type substance is unrestrained to form a gelled water column.

Preferably the gel type substance is unrestrained so as not to be encapsulated in a structure that limits the length of the gelled water column to exert increased lateral pressure on the walls of the blast hole.

Preferably the gel type substance comprises a super absorbent polymer gel that has been pumped into the blast hole to create a gelled column of water.

Preferably the gel type substance comprises a super absorbent polymer gel having hydroscopic and other properties allowing the gel to contact the explosive.

Preferably a zero to near zero interstitial free water volume is provided over a substantial portion of the gelled length; the zero to near zero interstitial free water volume serving to reflect the pressure wave generated by the explosive during blasting.

Preferably the super absorbent polymer gel extends into fissures in the wall of the blast hole to fill the fissures.

Preferably the super absorbent polymer gel is substantially water absorbed, at least along a substantial portion of the length of the super absorbent polymer gel.

Preferably the super absorbent polymer gel is substantially water absorbed before entering the blast hole.

Preferably the super absorbent polymer gel is fully water absorbed before entering the blast hole.

Preferably the gelled length is provided as a length of at least 100 mm.

Preferably the gelled length is provided as a length of at least 200 mm.

Preferably the gelled length is provided as a length of at least 500 mm.

Preferably the gelled length provides a length of at least 1 m.

Preferably the gelled length provides a length of at least 2 m.

Preferably the gelled length provides a length of at least 3 m.

Preferably the gel type substance has a specific gravity of between or equal to 1 and 2.

Preferably the gel type substance has a specific gravity greater than 1.0.

Preferably the gel type substance is formed by combining a super absorbent polymer with brackish waste water having a total dissolved solids between 100 to 5000 mg/L.

Preferably the gel type substance is formed by combining a super absorbent polymer with saline waste water having a total dissolved solids greater than 5000 mg/L.

The super absorbent polymer preferably: (i) retains more than 25 times its own mass; (ii) retain more than 100 times its own mass; (iii) retains more than 200 times its own mass; (iv) retains more than 300 times its own mass; (v) retains more than 400 times its own mass; and so forth.

According to an aspect of preferred embodiments herein described there is provided a method of stemming a blast hole, the method comprising: providing a gel type substance as a gelled length in the blast hole to increase the efficiency of an explosive during blasting; the explosive being located in the blast hole.

According to an aspect of preferred embodiments herein described there is provided a blast hole arrangement comprising: an explosive and a gel type substance in a blast hole; the gel type substance providing a gelled length in the blast hole to increase the efficiency of the explosive in the blast hole during blasting.

Preferred systems and methods herein described may provide a number of advantages including:

1) Being able to be applied fast and easily to all blast holes as compared to conventional technologies.

2) Providing a manner of addressing conventional aggregate or plug type stemming devices being ejected from the hole from time to time thus causing ineffectual blast pattern, reduced impact to rock and associated increase in downstream processing issues and costs. The use of the gelled water column in preferred stemming systems is considered to reduce the propensity for such events to occur.

3) Allowing the operator to re-enter the hole if an explosive charge misfires. All other stemming devices known to the applicant provide a plug creating a physical barrier which stops access to the unexploded change.

4) Increasing efficiency in comparison to traditional mechanical or physical stemming devices. To the best of the applicants knowledge no prior art or systems have the ability to reflect or reverse an explosive blast pressure wave in a blast hole application.

5) Because of achieving higher efficiencies in the direction and focus of the explosive gases less explosive is required. Consequently blast hole geometry, i.e. the depth and diameter of the blast hole may be reduced. Also the number of blast holes required may also be reduced delivering substantial savings to industry.

6) The gelled water column may be applied in 360 degrees in blast bore holes above or below ground.

It is to be recognised that other aspects, preferred forms and advantages of the present invention will be apparent from the present specification including the detailed description, drawings and claims.

BRIEF DESCRIPTION OF DRAWINGS

In order to facilitate a better understanding of the present invention, several preferred embodiments will now be described with reference to the following drawings in which:

FIG. 10 provides a tabulated summary of the test results shown in FIGS. 8 and 9.

DETAILED DESCRIPTION OF THE EMBODIMENTS

It is to be appreciated that each of the embodiments is specifically described and that the present invention is not to be construed as being limited to any specific feature or element of any one of the embodiments. Neither is the present invention to be construed as being limited to any feature of a number of the embodiments or variations described in relation to the embodiments.

Figure 1:
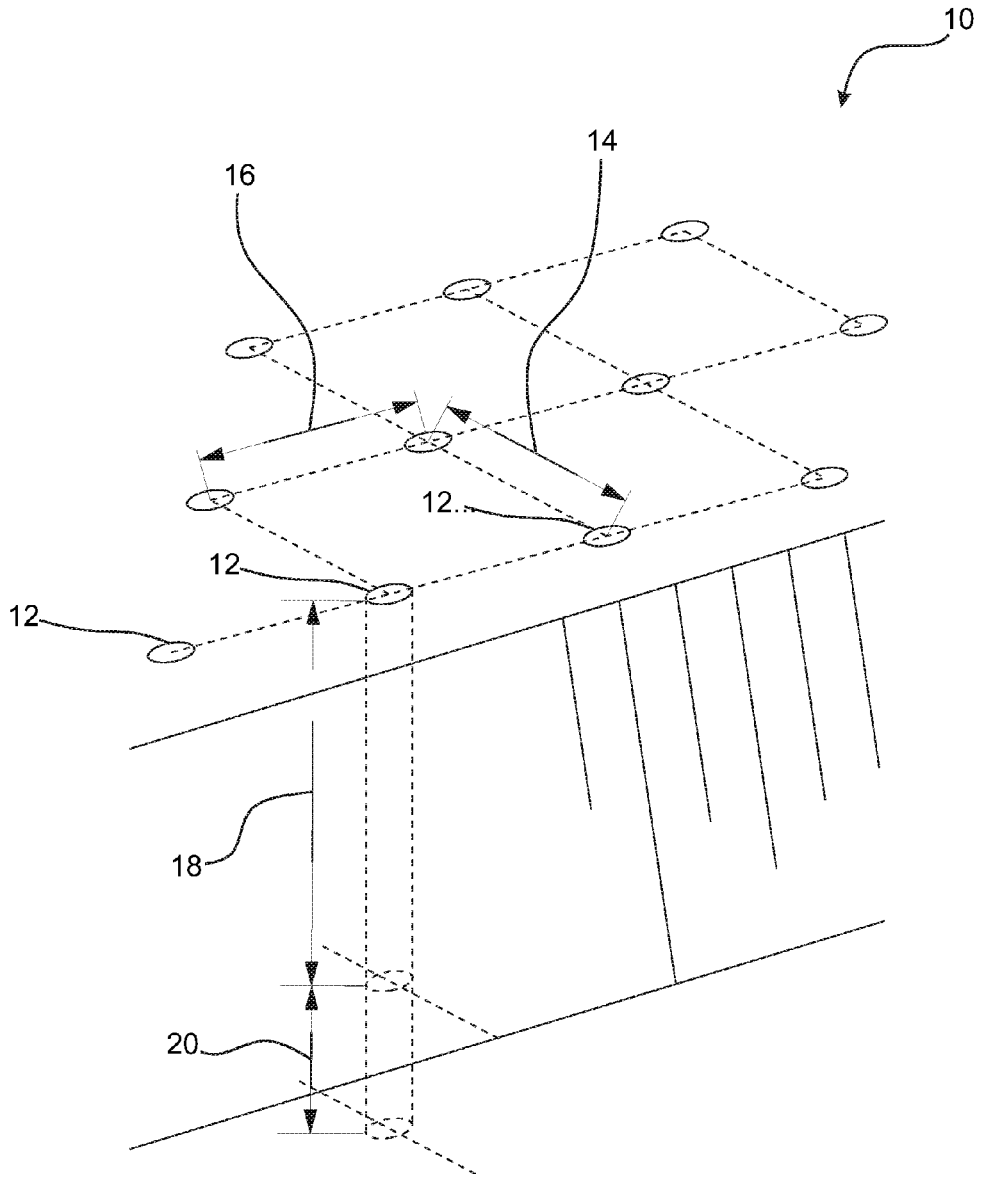
FIG. 1 provides a perspective view of a blasting bench.

Referring to FIG. 1, there is shown a blasting bench 10. The blasting bench 10 includes a number of drill boreholes 12 arranged in a grid configuration. The blasting bench provides a burden 14, a spacing 16, a bench height 18, a sub drill depth 20. In operation there is an initiation sequence for detonation and successive row and hole firing.

Depending on the structure of the rock the holes 12 may have a 6 inch diameter and be spaced about say 12 feet apart. The amount of explosive used in each borehole depends on a number of factors including the type of the explosive, borehole depth and diameter, sub drill depth, spacing, burden and the borehole detonation sequence. Each of these factors as well as other factors define the parameters of a blasting programme.

Assuming that conventional stemming aggregates or control plugs are used in the boreholes 12 and function as intended, the control plugs operate to constrain explosion gasses. The rock is blasted and fragmented into rock suitably sized for subsequent processing.

If however one or more of the control plugs do not function as intended and are blasted out the boreholes 12, the associated blasting programme can be compromised. In circumstances this can result in having to remove large pieces or sections of rock from the blasting bench 10 as well as possibly having to reblast. The process of removing such rock, secondary blasting and mechanical breaking have associated time and labour costs. Producing rock that has been blasted and fragmented into suitably sized pieces is the primary role of ore production. Unsatisfactory blasting resulting in downstream increase in materials handling costs are of concern to quarry and mine site operators.

Figure 2:
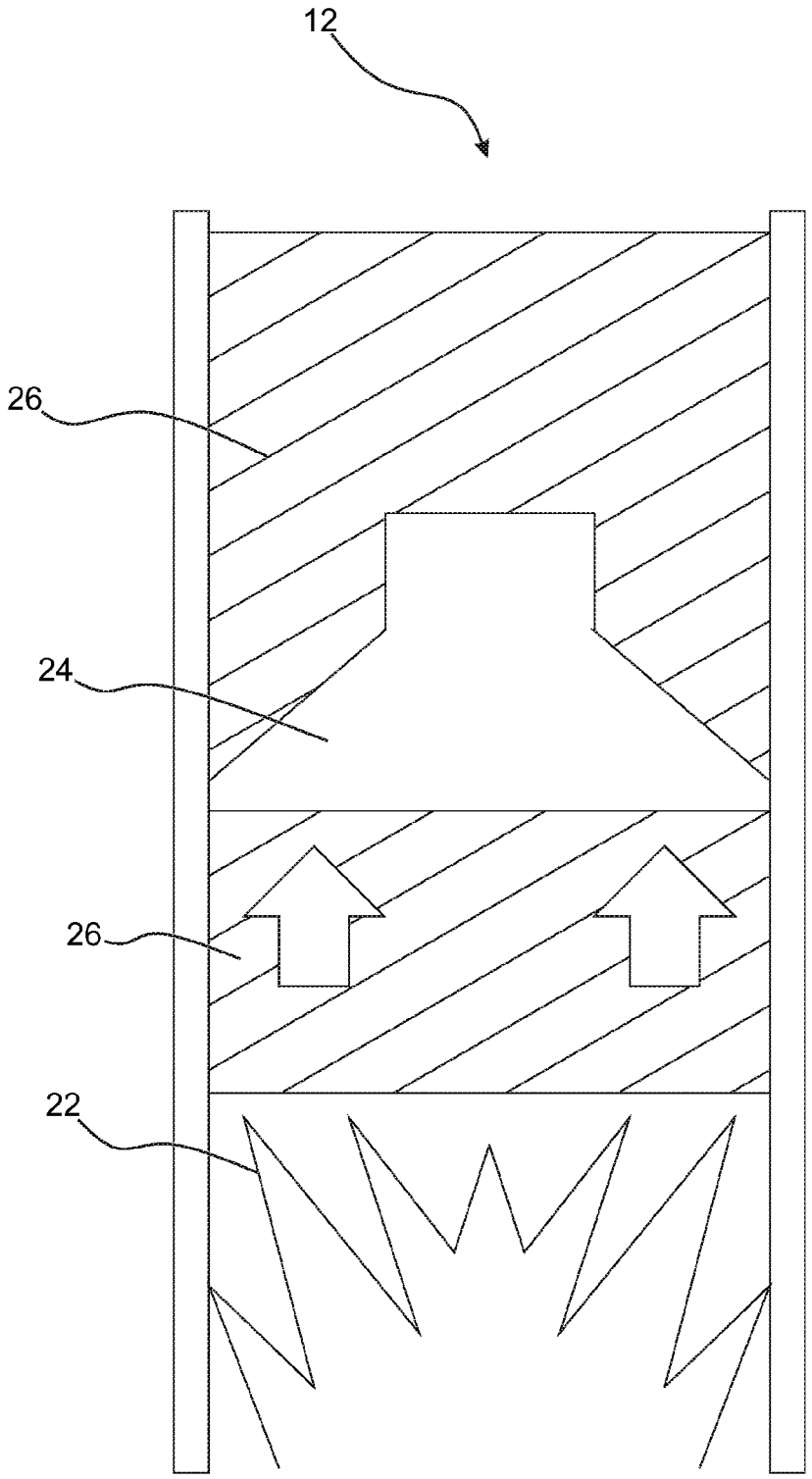
FIG. 2 provides a schematic view of an explosion within a borehole.

Turning to FIG. 2 there is shown an explosion 22 within a borehole 12. A stemming device 24 in between two sections of rock packing 26 is provided. By having the stemming device 24 in position above the explosion 22 this serves to prevent explosion gases from venting upwards. When explosion gases vent, this has the effect of reducing the explosive force on the adjacent rock as well as creating air blast and fly rock.

In the case of the stemming device, depending on the conditions, the stemming device 24 could be blasted out of the borehole 12 and adversely disturb the effect of the blast sequence.

Figure 3:
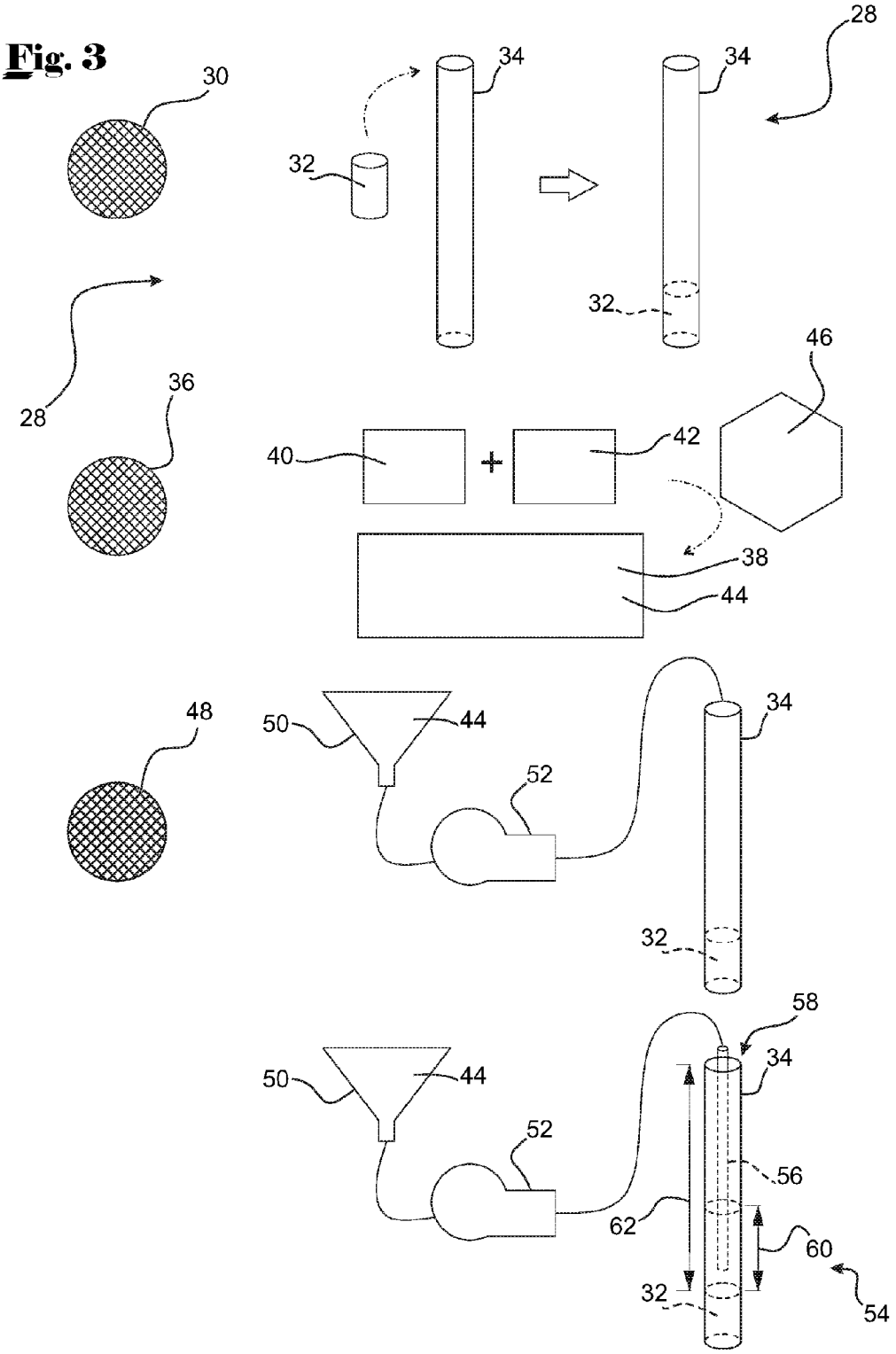
FIG. 3 provides an illustration of a method according to a first preferred embodiment of the present invention.

FIG. 3 illustrates a method 28 according to a first preferred embodiment of the present invention. The method 28 provides several advantages discussed in further detail below.

At block 30 of the method 28, an explosive 32 is inserted into and positioned at the bottom of a blast hole 34. At block 36 a gel type substance 38 (a gel or otherwise) is prepared for pumping into the blast hole 34.

The process at block 36 comprises providing a pressure wave stemming reagent 40. The pressure wave stemming reagent 40 provided is reacted with water 42 to form the pressure wave stemming media gel 44 (the super absorbent polymer gel). The water 42 is provided from a water source 46.

Advantageously the pressure wave stemming reagent 40 is transported to the location of the blast hole 34 at a mine site. The pressure wave stemming reagent 40 is provided as a package that is mixed with the water 42.

At block 48, the method 10 includes pumping the reacted pressure wave stemming media 44 from a system 50 into the blast hole 34 using a pump 52.

As part of block 48, the reacted pressure wave stemming media 44 is pumped directly at the lower end 54 of the blast hole 34. For this purpose a tube 56 extends down the blast hole 34 to deliver the reacted pressure wave stemming media 44 into the desired position. As the reacted pressure wave stemming media 44 is delivered through the tube 56, the tube 56 is raised as part of the method 10. In this manner the blast bore 34 is progressively filled with the reacted pressure wave stemming media 44 from above the explosive 32 in a direction extending towards the upper opening 58 of the blast hole 34.

Notably the reacted pressure wave stemming media 44 is provided as a gelled length 60 that fills a portion of the remaining length 62 of the blast hole 34. The gelled length 60 provides a pressure wave stem media 60 in the form of a gelled water column 60 that is of a height suited to the blasting conditions.

As will be detailed in relation to FIGS. 8 to 12, it is considered that pressure wave stems of the embodiments will be effective in confining and controlling gas pressure in the blasting. Presently, the differential in energy loss is considered to only be attributable to the majority of the pressure wave energy being reflected.

With water being substantially incompressible the gelled water column 60 is advantageously provided with a substantial quantity of water, the amount of water and form of the column being sufficient to advantageously operate on what would be the pressure wave from the explosive after detonation.

The gelled water column 60 provides a substantial continuous length that serves to desirably reflect the pressure wave to increase the efficiency of the explosive 32 during blasting.

Figure 4:
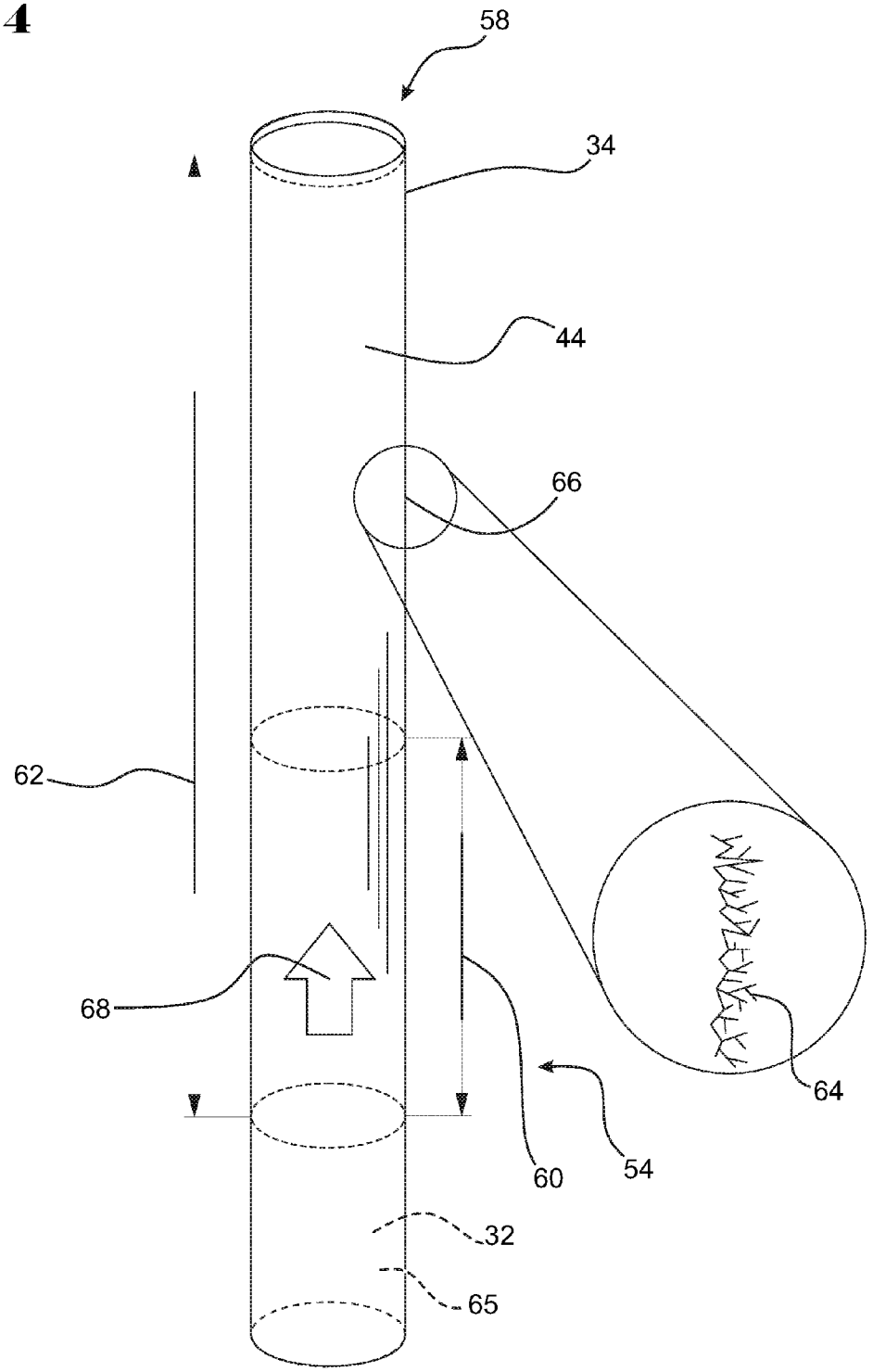
FIG. 4 provides a further illustration in relation to the method shown in FIG. 3.

Referring to FIG. 4, the explosive 32 is provided as an explosive 65 of a particular form. Advantageously the reacted pressure wave stemming media 44 has characteristics (hydroscopic and other properties) that allow the reacted pressure wave stemming media 44 to contact the explosive 65. Advantageously in the reacted pressure wave stemming media 44, a zero to near zero interstitial free water volume is provided.

The column of reacted pressure wave stemming media 44 and the pumping of the reacted pressure wave stemming media 44 at block 48 is considered to advantageously have the ability to fill fissures 64 in the wall 66 of the blast hole 34.

The reacted pressure wave stemming media 44 is provided with a specific gravity over 1.0 while substantially maintaining the gel type properties of the reacted pressure wave stemming media 44. Increasing the specific gravity of the reacted pressure wave stemming media will increase the hydrostatic pressure exerted by the gelled length of water 44.

Although the length of the water column 60 will be determined by the blasting parameters, the gelled length provided could provide a substantial hydrostatic head that assists with reflecting the pressure wave from the explosive 65.

Figure 5:
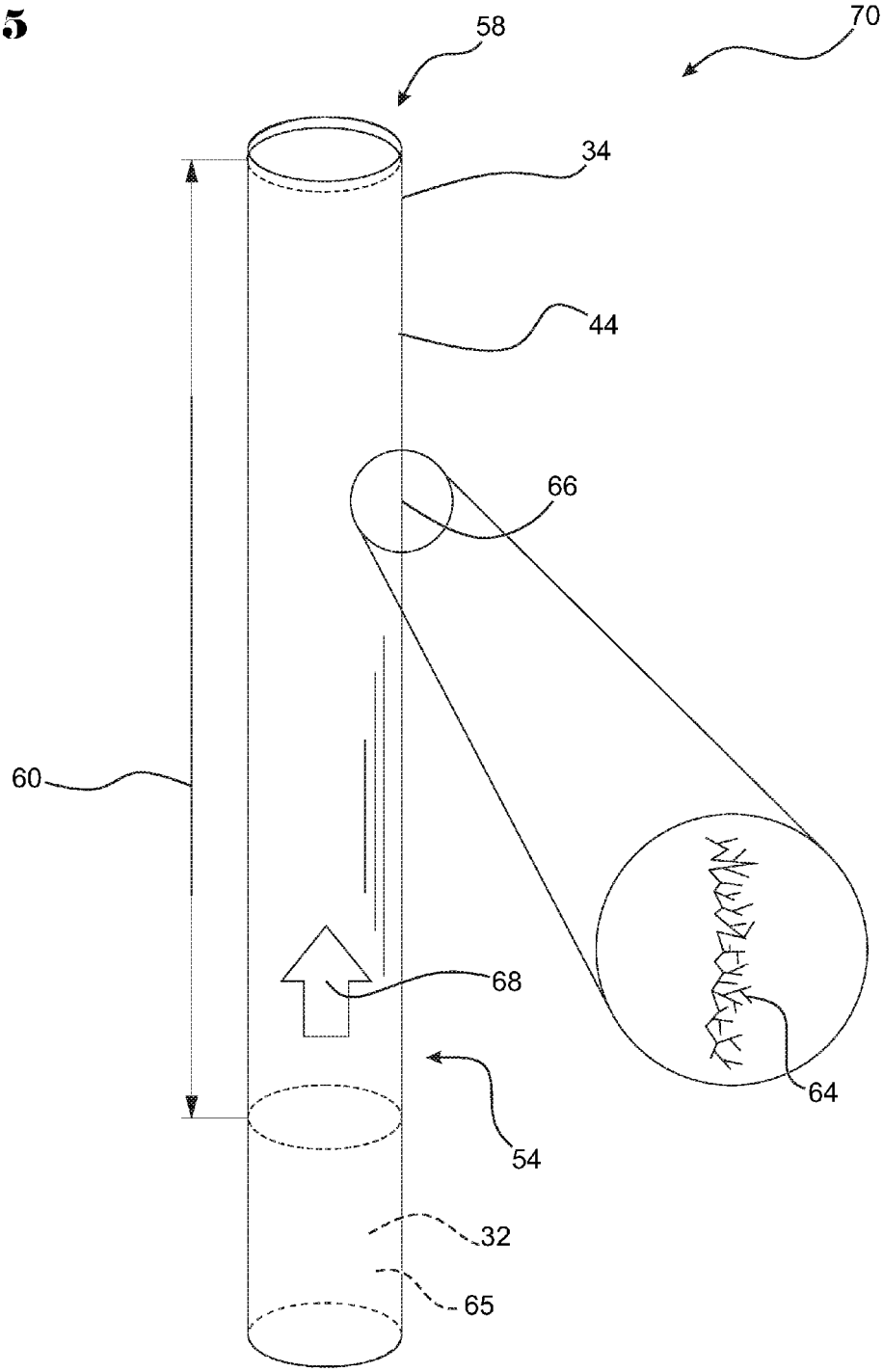
FIG. 5 provides an illustration of a blast-hole arrangement according to a further preferred embodiment of the present invention.

Referring to FIG. 5, the method 28 is considered to provide a blast hole arrangement 70 according to a further preferred embodiment of the present invention. The blast hole arrangement 70 comprises an explosive 32 and a gel type substance 38 (the gel 44) in a blast hole 34. The reacted pressure wave stemming media 44 is in contact with the explosive 32 and reflects the pressure wave through a path of least action to the region below the reacted pressure wave stemming media 44.

Notably the reacted pressure wave stemming media gel 44 extends into fissures 64 in the wall 66 of the blast hole 34. The reacted pressure wave stemming media gel 44 is substantially water absorbed before entering the hole, and as a result, when in the blast hole 34.

The reacted pressure wave stemming media gel type substance has a specific gravity greater than 1.0. During detonation of the explosive 32 and the subsequent generation of the pressure wave the reacted pressure wave stemming media gel 44 (remaining or otherwise) acts to reflect the energy of the pressure wave away from the open stemmed hole redirecting the explosion gases downwardly into the blast hole 34 and laterally into walls thereof and preferentially towards any ridged surface.

In this embodiment the reacted pressure wave stemming media gel 44 is advantageously formed by combining the pressure wave stem reagent with saline waste water having a total dissolved solids greater than 10,000 mg/L from a mine site desalination process waste. Generally such waste water has to be discharged into the environment and comprises salt water with high total dissolved solids. Waste water of this type is known to be particularly problematic and to be associated with several environmental problems. The present embodiment provides an advantageous manner of disposing of such water.

As would be apparent the embodiments make advantageous use of water as a stemming device in blast holes. As a part of the process the water is transformed into a gel using the pressure wave stem reagent.

The gelling reagent that is used advantageously has the ability to gel water over a broad range of water types. From very low total dissolved solids (TDS) to very high total dissolved solids.

The gelled fluid is pumped down the bore after the explosive charge is set. This creates a gelled column of water on top of the explosive. The column of gelled fluid could be of any suitable height above the explosive charge and may fill the entire bore hole to surface.

Notably the almost instantaneous gelling characteristics of the reagent could allow for gel stemming of blast holes from vertical to horizontal bore holes, over possibly a full 360 degrees. Consequently the gel stemming system may find application in surface blasting or underground blasting. In non-vertical applications the gel could be made stiff to not flow out of the bore hole. Various gel retaining systems could also be used. As would be apparent the gelled fluid may be used: (i) above, (ii) below, (iii) above and below or (iv) consecutively above and below the explosive charge depending on the operators desired blasting requirements. This traditionally is known as decking.

The density of the gel may be increased by the use of a soluble or insoluble weighting agents such as sodium chloride (NaCl) or weighting agent such as barite, (barium sulphate). This allows for the adjustment of the hydrostatic pressure exerted on the bottom of the bore hole and to the sides of the bore hole. This in turn may relate to balancing the explosive charge to the gel stemming system.

It is considered that both the reflection of the blast pressure wave by the column of gelled fluid and the hydrostatic pressure exerted on the bottom of the bore hole should result in a substantial decrease of explosives required to do comparable work. This is considered to have demonstrated by testing as will be discussed in relation to FIGS. 8 to 12.

With conventional stemming devices, despite their all being only attempts to physically confine the explosives gas pressure, improvements have been seen. It is considered that substantially incremental improvements should accordingly be seen with the pressure wave stemming embodiments, as compared to all conventional stemming devices.

WO2012/090165 is entitled 'Tamping Device and Method' to Roderick Smart and filed 28 Dec. 2011. The document describes a stemming device that uses a super absorbent polymer. The super absorbent polymer is contained in a short length of semipermeable material that is positioned in the borehole.

The document envisages a plug type stemming device where the semi-permeable membrane is soaked with an aqueous liquid, either before or after its insertion into the blast hole, so that it expands into contact with the wall of the blast hole. The use of a capsule of the form envisaged by WO2012/090165 is considered to be largely equivalent to a conventional plug. Example tap sizes discussed in WO2012/090165 include a 240 mm and 300 mm stemming devices.

Firstly soaking merely before entry is unlikely to provide a ready fit with the borehole. Soaking in the borehole could provide other complications. In the case of a capsule that is wet in the manner envisaged by WO2012/090165 the applicant considers that the capsule might continue to suck the water into the super absorbent polymer until there is no more interstitial water left in between the particles leaving air gaps. Thus acting as traditional stem. To remedy free water would have to be introduced to the blast hole. This is not compatible with water sensitive explosive types. Free water in blast holes also creates other disadvantageous issues in blast management.

Moreover, the document envisages only a restrained membrane that absorbs water that forces the membrane laterally outwardly. For this purpose there is an excess of super absorbent polymer to water for absorption for continually expanding the membrane. The system does not envisage the provision of a gelled water column that is able to redirect a pressure wave from an explosive charge. The applicant considers that the pressure wave would pass through the plug of WO2012/090165 for the reasons discussed. The plug of WO2012/090165 is likely to be ejected out of the bore restraining the explosion gases only relatively short period of time if at all.

In the present embodiments described there are no air pockets and no enclosing semi permeable membrane. The pressure wave caused by the explosion is redirected by the column of the gel. The hydrostatic head may play a role in the restraint and reflection of the pressure wave.

Super absorbent polymers (SAP) noted in WO2012/090165 include polyacrylamide, polyvinyl alcohol, cross-linked polyethylene oxide, polymethylacrylate and polyacrylate salts. The polyacrylate salt is said to be preferably selected from sodium polyacrylate, potassium polyacrylate, lithium polyacrylate and ammonium polyacrylate.

Figure 6:
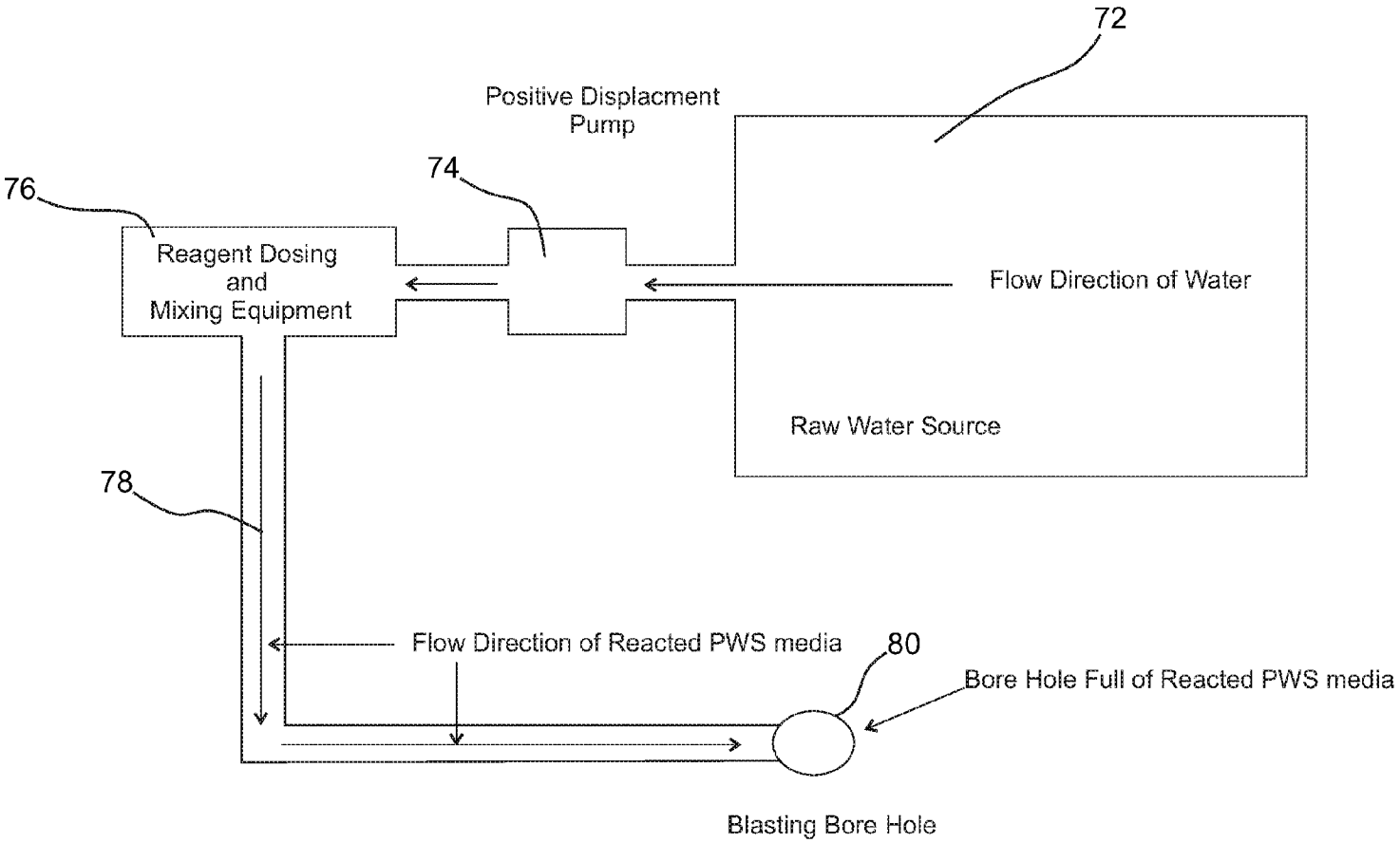
FIGS. 6 and 7 illustrate the operation of another embodiment of the present invention.
Figure 7:
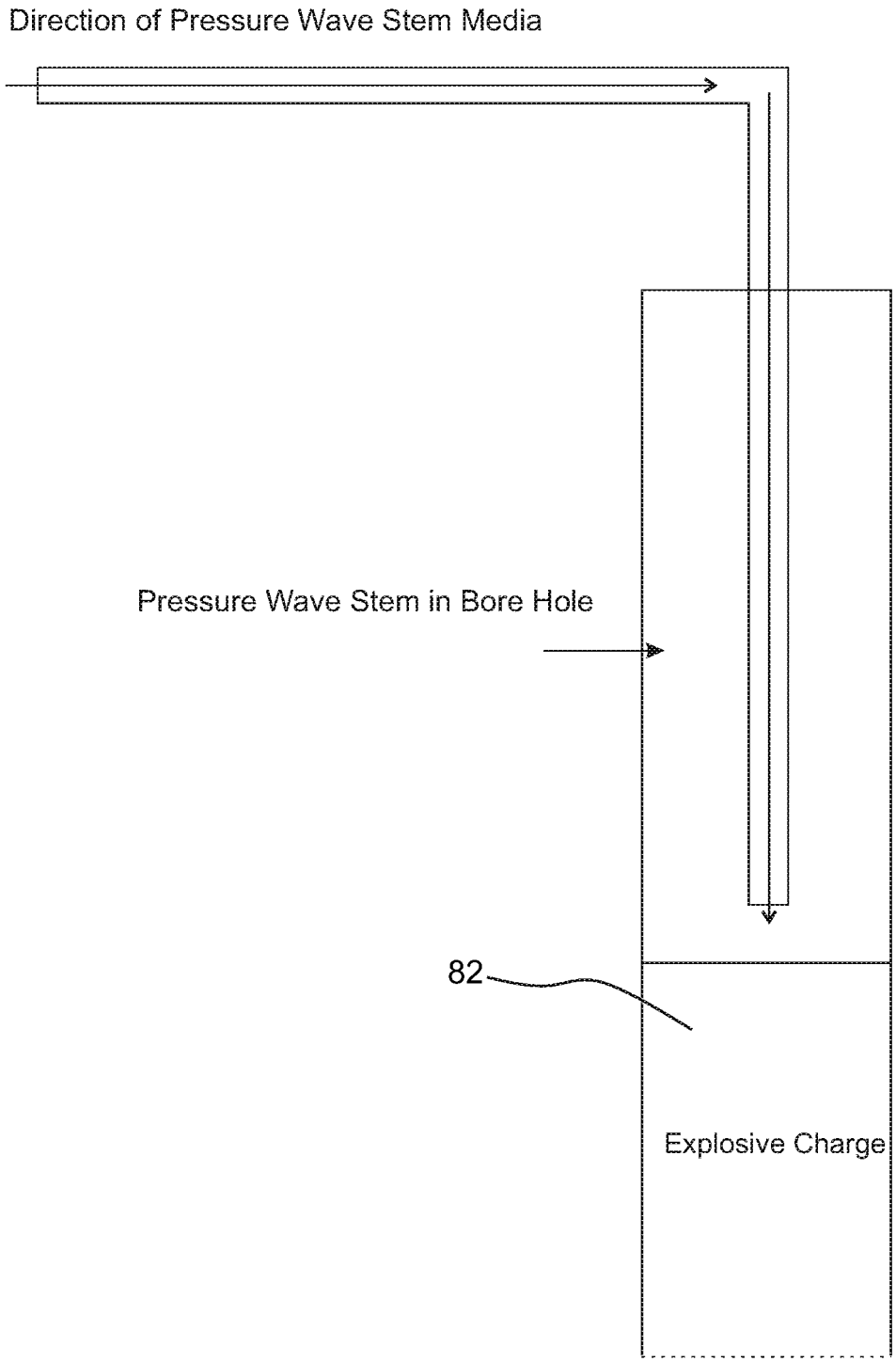

FIG. 6 illustrates the basic operation of another embodiment of the present invention. In the embodiment a raw water source 72 is connected to a positive displacement pump 74. The pump 74 delivers the water to a reagent dosing station and mixer 76. The resultant reacted pressure wave stemming media gel 78 is then delivered to a bore hole 80. As shown in FIG. 7 the reacted pressure wave stemming media gel 78 is delivered above an explosive charge 82.

In the embodiment, the application is made by dosing the reagent into a fluid stream. The water could be supplied from a water truck, site dam, waste stream of Reverse Osmosis (RO) plant or water storage vessel and pumped in line to the reagent mixing equipment. Sufficient residence time is allowed for the reaction between the reagent and water to form the gel. Appropriate kinetic energy is applied to allow the reaction to occur. A flexible hose is placed in the bore hole and the resulting gelled fluid is pumped out at a measured rate for filling the hole. The hose is raised as the gel flows into the hole.

A positive displacement pump is used to pump the gelled fluid. After filling, the hose is removed from the bore hole. The hose is then placed in the next bore hole and the process is repeated.

As discussed the propensity for conventional aggregate stemming or plug type stemming devices to be ejected from the hole is problematic. Failure of one or more traditional stemming devices in a blasting programme can result in an ineffectual blast, reduced impact to the rock, and an irregular blast pattern. This causes downstream processing issues that affect the profitably of the mine site and the plant. The present embodiment should provide repeatable and consistent blasting performance.

In terms of the waste water advantage, many mine sites provide portable water through Reverse Osmosis (RO) equipment. The waste stream from Reverse Osmosis plants is often very high in TDS and problematic to dispose of. The embodiments provide an advantageous manner of disposal.

In terms of explosives the embodiments should provide for a reduced amount of explosive consumption in a blasting programme.

Due to the reduced explosive power required it may consequently be possible to make beneficial adjustments to the bore hole depth, diameter and other blasting characteristics. This may provide savings in time and energy required for drilling and preparing the blasting bore hole array.

Another advantage is that it is possible to re-enter the hole through the gel column if an explosive charge misfires. Traditional stemming devices provide a plug that creates a physical barrier that prevents ready access to the unexploded charge. All other conventional plug type barriers create a physical barrier which stops the easy access to the unexploded change.

Additionally traditional stemming devices are time consuming and difficult to put in place. They often require a tight fit which can be difficult to provide given the broken ground of the bore hole. The time and reliability aspects of the gel fluid stemming system in embodiments is considered to be advantageous.

The applicant also considers that the pressure wave stemming (PWS) system of the embodiments can be applied readily in a variety of conditions.

Figure 8:
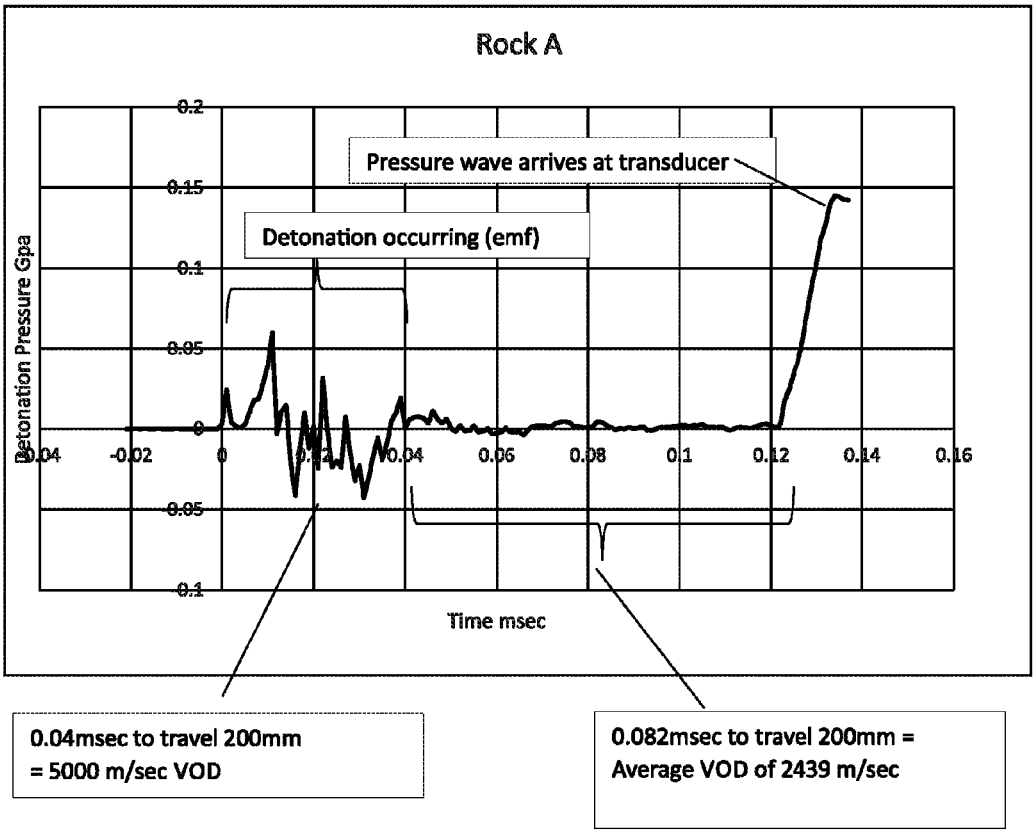
FIGS. 8 and 9 provide graphs illustrating a number of test results.

Referring to FIG. 8 there is shown the results of a transducer control test of an explosion in a bore hole having a depth of 670 mm above the explosive. The transducer was located 200 mm above the explosive. The borehole was filled with the reacted pressure wave stemming reagent and water. The testing was performed by QMR Blasting Analysis Queensland, Australia considered to be a leading internationally recognised industry specialist In terms of result output from the transducer as shown in FIG. 8, the data recorded measured the pressure wave at 0.082 ms to travel 200 mm (pressure wave stem height) at an average Velocity of Detonation (VOD) of 2,439 m/sec. The calculated Velocity of Detonation (VOD) of the explosives used was 5,000 m/sec. This corresponds with a reduction in VOD of approximately 51% over 200 mm.

The measured detonation pressure at 200 mm above the explosive was 0.14 GPa. The calculated detonation pressure of the explosives used was 7.5 GPa, (i.e., a 98% reduction in detonation pressure from the calculate 7.5 GPa).

Figure 9:
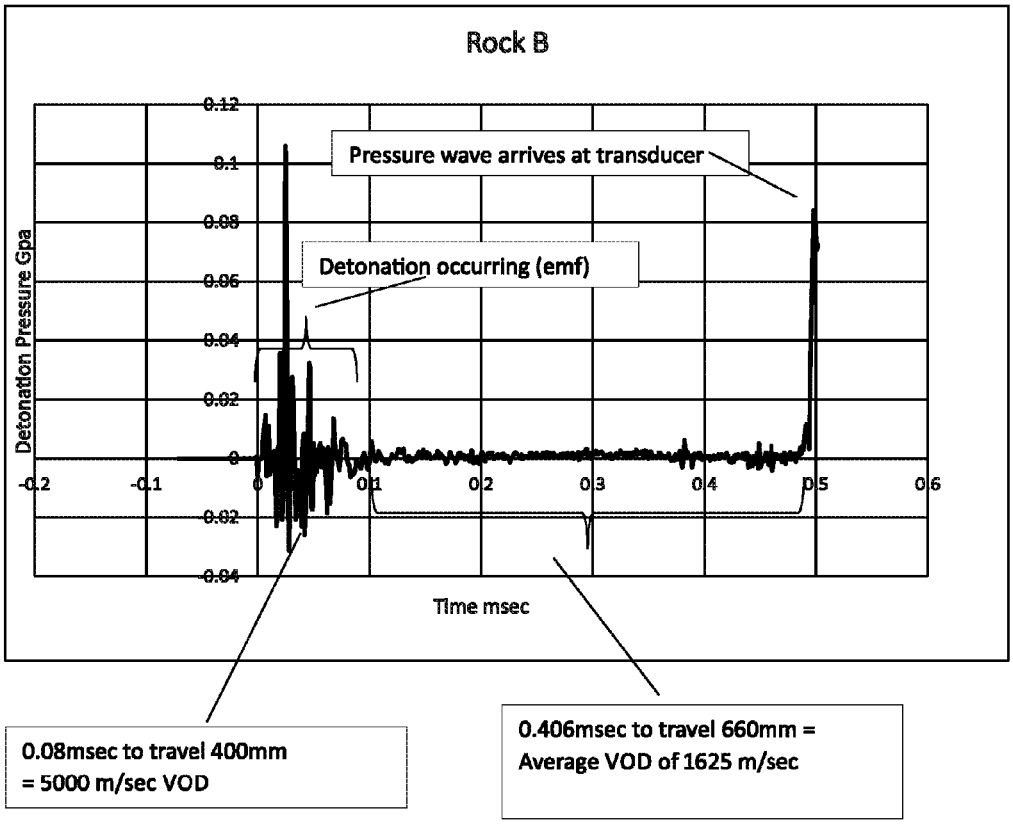

Referring to FIG. 9 there is shown the results of the transducer at 660 mm above the explosive. The output from the transducer is considered to illustrate the presence of a pressure wave taking 0.406 ms to travel 660 mm at average speed of 1,625 m/sec. This indicates a reduction in VOD of 67.5% over 660 mm and a measured detonation pressure of 0.084 GPa at 660 mm being 99% reduction in detonation pressure, (again with the explosive used having a detonation pressure calculated at 7.5 GPa.

As discussed, the new stemming material attenuated 98% of the detonation pressure over a distance of 200 mm. The velocity of propagation of the detonation pressure wave decreased over the length of the stemming indicating changes in the physical characteristics along the length of the stemming. The differential in energy loss can only be attributed to the majority of the pressure wave energy being reflected.

Thus, it is considered that the embodiments provide an advantageous pressure wave stemming (PWS) product technology that operates to reflect the pressure wave energy generated by the detonation pressure which in turn redirects expanding gases and associated pressure preferentially towards any ridge surface (towards the sides of the bore hole away from the bore hole opening).

The blast pressure wave as demonstrated by the tests is reflected by our PWS system thus reversing and focusing the expanding gases towards any ridge surface. In existing systems it is considered that the blast pressure wave will pass through existing stemming devices potentially destabilising the stem and play no part in gas containment.

The embodiment advantageously makes use of the relationship between: the detonation energy; the hydrostatic pressure exerted by the column of PWS; the speed at which the pressure wave is generated, usually being 3-5 msecs after detonation as compared to 24 msecs for the propagation of gases; blast hole geometry; and operational requirements.

For dosing purposes the PWS reagent is provided as a liquid to be reacted with water before admission into the borehole. In embodiments, the liquid PWS reagent (before adding to water and pumping down the bore hole) may be a solution, an emulsion, a dispersion of soluble or insoluble hydrophilic molecules. The liquid PWS reagent preferably takes on a minimum of 25:1 its own weight in water.

The advantages of the system, potential or otherwise include: having the ability to be applied fast and easily to all blast holes; providing a manner to address ineffectual blast pattern by focusing energy to rock reducing the propensity to create oversize and subsequent down-stream processing issues; allowing the operator to re-enter the hole if required; the depth and diameter of the blast hole being able to be reduced; the number of blast holes required being able to reduced—delivering substantial savings to industry; practical disposal of waste water (for example from RO plants); the potential for conventional aggregate stemming to strip or damage detonation wiring; and reducing stem height required.

Additional advantages may include the ability to alter the drill pattern, reduce air/dust blast, control fly rock, control rock fragmentation and so forth. The advantages associated with conventional stemming are of course also provided.

The embodiments do not employ a bore cartridge or semi permeable sheath. The gel is pumped into the hole without free water. This allows cheaper water sensitive explosives like ANFO to be more cost effectively used.

As would be apparent, various alterations and equivalent forms may be provided without departing from the spirit and scope of the present invention. This includes modifications within the scope of the appended claims along with all modifications, alternative constructions and equivalents.

There is no intention to limit the present invention to the specific embodiments shown in the drawings. The present invention is to be construed beneficially to the applicant and the invention given its full scope.

In the present specification, the presence of particular features does not preclude the existence of further features. The words 'comprising', 'including' and 'having' are to be construed in an inclusive rather than an exclusive sense.

It is to be recognised that any discussion in the present specification is intended to explain the context of the present invention. It is not to be taken as an admission that the material discussed formed part of the prior art base or relevant general knowledge in any particular country or region.

The claims defining the invention are as follows:

1. A method of stemming a blast hole, the method comprising pumping a super absorbent polymer gel having at least a 25:1 ratio of water to super absorbent polymer into a blast hole loaded with explosive to create an unrestrained gelled column of water, thereby providing a pressure wave reflecting stem in the blast hole to increase efficiency of the explosive during blasting, wherein the gelled column of water reduces detonation pressure by at least 98% over a distance of 200 mm.

2. The method as claimed in claim 1 wherein the gelled column of water freely contacts a wall of the blast hole.

3. The method as claimed in claim 2 wherein the gelled column of water exerts increased pressure on the wall of the blast hole.

4. The method as claimed in claim 1 wherein the method further comprises ensuring that the water and super absorbent polymer are fully reacted to form the super absorbent polymer gel before said pumping.

5. The method as claimed in claim 1 comprising pumping the super absorbent polymer gel into the blast hole loaded with explosive to create the gelled column of water having a vertical height of at least 100 mm above the explosive.

6. The method as claimed in claim 1 wherein the super absorbent polymer gel comprises a super absorbent polymer and brackish waste water having a total dissolved solids value in a range of from 100 to 5000 mg/L.

7. The method as claimed in claim 1 wherein the super absorbent polymer gel comprises a super absorbent polymer and saline waste water having a total dissolved solids value of greater than 5000 mg/L.

8. The method as claimed in claim 1, wherein the gelled column is (i) above the explosive, (ii) below the explosive, (iii) above and below the explosive, or (iv) consecutively above and below the explosive.

9. The method as claimed in claim 2, wherein pumping said super absorbent polymer gel into the blast hole fills fissures in the wall of the blast hole.

10. The method as claimed in claim 1, wherein the blast hole comprises a horizontal blast hole.

11. The method as claimed in claim 1, wherein the blast hole is oriented at an angle over a 360° range.

12. The method as claimed in claim 1, wherein said super absorbent polymer gel further comprises a soluble or an insoluble weighting agent to increase a density of said super absorbent polymer gel.

13. The method as claimed in claim 1, wherein the super absorbent polymer is selected from a group comprising polyacrylamide, polyvinyl alcohol, cross-linked polyethylene oxide, polymethylacrylate, and polyacrylate salts.

14. The method as claimed in claim 1 further comprising re-entering the blast hole through the gelled column of water if an explosive charge misfires.

15. The method as claimed in claim 1, wherein the gelled column of water reduces air/dust blast during blasting.

16. The method as claimed in claim 1, wherein the super absorbent polymer gel has at least a 100:1 ratio of water to super absorbent polymer.

* * * * *